US005548380A

United States Patent [19]

Naka et al.

[11] Patent Number: 5,548,380

[45] Date of Patent: Aug. 20, 1996

[54] CHARGING DEVICE AND AN IMAGE FORMING APPARATUS USING A CHARGING DEVICE

[75] Inventors: Teruyuki Naka, Izumi; Yoshio Umeda, Kobe; Toshiki Yamamura, Hirakata; Akira Kumon; Seiichi Suzuki, both of Katano; Junichi Nawama, Osaka; Hisanori Nagase, Hirakata, all of Japan

[73] Assignee: Matsushita Electric Industrial Co., Ltd., Kadoma, Japan

[21] Appl. No.: 365,206

[22] Filed: Dec. 28, 1994

[30] Foreign Application Priority Data

| | | | |
|---|---|---|---|
| Dec. 28, 1993 | [JP] | Japan | 5-336370 |
| Jun. 7, 1994 | [JP] | Japan | 6-147003 |
| Oct. 21, 1994 | [JP] | Japan | 6-281543 |
| Dec. 2, 1994 | [JP] | Japan | 6-299347 |

[51] Int. Cl.[6] ..... G03G 15/02

[52] U.S. Cl. ..... 355/219; 361/225

[58] Field of Search ..... 355/219; 361/225, 361/230

[56] References Cited

U.S. PATENT DOCUMENTS

| | | | |
|---|---|---|---|
| 4,967,231 | 10/1990 | Hosoya et al. | 355/219 |
| 5,008,706 | 4/1991 | Ohmori et al. | 355/219 |
| 5,068,762 | 11/1991 | Yoshihara | 361/225 |
| 5,089,851 | 2/1992 | Tanaka et al. | 355/219 |
| 5,126,913 | 6/1992 | Araya et al. | 361/225 |
| 5,235,386 | 8/1993 | Yano et al. . | |
| 5,241,343 | 8/1993 | Nishio | 355/219 |
| 5,312,662 | 5/1994 | Ohta et al. . | |
| 5,353,101 | 10/1994 | Adachi et al. | 355/219 |
| 5,402,213 | 3/1995 | Ikegawa et al. | 355/219 |
| 5,418,605 | 5/1995 | Arahira et al. | 355/219 |

FOREIGN PATENT DOCUMENTS

| | | |
|---|---|---|
| 0367203A3 | 5/1990 | European Pat. Off. . |
| 0417801A3 | 3/1991 | European Pat. Off. . |
| 0574208A3 | 12/1993 | European Pat. Off. . |
| 0642063A1 | 3/1995 | European Pat. Off. . |
| 1066676 | 3/1989 | Japan . |

OTHER PUBLICATIONS

European Search Report dated May 1, 1996.

*Primary Examiner*—R. L. Moses
*Attorney, Agent, or Firm*—Ratner & Prestia

[57] ABSTRACT

A charging device for charging a movable object to be charged. A charging member contacts the object to be charged. A power source applies a voltage to the charging member, wherein the power spectrum PS satisfies the following relation when the space frequency of the profile of the surface of the charging member is analyzed.

In the section of $10 \leqq f \leqq 100$ (cycles/mm):

$$PS \leqq -2.5 \times \log (f/2) (\mu m^2)$$

In this way, the charging device prevents charge unevenness due to undulations on the surface of the charging member and charges uniformly while generating very little ozone.

25 Claims, 7 Drawing Sheets

CHARGING DEVICE AND AN IMAGE FORMING APPARATUS USING A CHARGING DEVICE

BACKGROUND OF THE INVENTION (1) Field of the Invention

The present invention relates to a device for charging a member to be charged, and an image forming apparatus using this charging device, and more particularly to a charging device used in an image forming electrophotographic system.

(2) Description of the Prior Art

In the past image forming electrophotographic systems have been widely used in copiers, laser beam printers, and other devices. As known well, in such electrophotographic systems, a corona discharge device is widely used for charging a photosensitive member. Generally, a corona discharge device comprises a fine wire and a shield electrode. A high voltage of about 4 to 5 kV is applied to the wire, and the photosensitive member is uniformly charged by the discharge taking place between the fine wire and shield electrode. For uniformity of charging of the photosensitive member, an electrode a grid may be disposed between the wire and the photosensitive member, and it is known as a Scorotron. At present, the Scorotron is very widely used.

However, the Scorotron requires a power source capable of applying a very high voltage of several kilovolts in order to stabilize the discharge. When discharging, moreover, ozone harmful to human health is massively generated. Accordingly, apparatus for treating the ozone is needed, or the photosensitive member may be deteriorated by the ozone.

Accordingly, methods and apparatus of very small ozone output have been proposed. They are intended to keep a conductive charging material in contact with the photosensitive member to be charged, and generate discharge between them, as well as the photosensitive member directly. As a result, the discharge for charging the photosensitive member may be kept to a necessary minimum limit, so that the ozone output can be reduced.

Known apparatus for charging directly by contacting with the photosensitive include a method using a conductive elastic roller as a charging member (Japanese Patent Publication No. 62-11343), and a method for using a fiber brush (Japanese Laid-open Patent No. 56-147159) are known among others. From the viewpoint of forming method of discharge electric field, a method of applying a direct-current voltage to a charging member (Japanese Laid-open Patent No. 58-194061), and a method of applying by superposing an alternating-current voltage and a direct-current voltage (U.S. Pat. No. 4,851,960) are known.

In the method using fiber brush, however, the contact state between the photosensitive member and fiber brush is unstable and charging is not uniform. Further, bristles of the fiber brush deteriorate or fall down due to aging effects, and charging is not stable.

By contrast, in the method using an elastic roller, as compared with the fiber brush, the contact state is relatively uniform, and aging effects are smaller. But, with the elastic roller, too, uneven charging due to surface roughness and uneven resistance of the roller also occurs. With respect to the voltage applied to the roller, the example of applying may be compared with the example of applying by superposing AC voltage and DC voltage. The charging uniformity has been found to be superior and the tolerance greater in the application method by superposing AC voltage and DC voltage. However, to apply AC voltage, a vibratory electric field is formed between the elastic roller and photosensitive member, which causes noise known as charging noise. This charging noise is the noise determined by the frequency of the applied voltage, and in particular it falls in the human audible frequency range (20 to 20000 Hz, especially 200 to 2000 Hz). To avoid this, therefore, it is necessary to lower (below 200 Hz) or raise (over 2000 Hz) the AC frequency. When the AC frequency is raised, the AC voltage attenuates extremely in the charging member and the efficiency is very poor. When the AC frequency is lowered, periodic charge unevenness occurs in the peripheral direction of the photosensitive member.

Supposing the AC frequency to be f (Hz) and the moving speed of the photosensitive member (called process speed) to be $V_p$ (mm/sec), periodic charge unevenness occurs at a pitch of $V_p/f$ mm in the peripheral direction of the photosensitive member. Its reason is explained below. First, the vibratory electric field gradually attenuates in the separating region of the charging member, and the surface potential of the photosensitive member converges at the superposed DC voltage. At this time, the applied AC frequency is finite, and at the end of charging (that is, when the surface potential of the photosensitive member converges), transfer of electric charge from the charging member to the photosensitive member and reverse transfer do not take place at the same time. Therefore, depending on the phase of the AC frequency at that time, charging is terminated when the final transfer or reverse transfer occurs. The phase of the AC voltage at the end of charging is the same regarding the axial position on the photosensitive member, but is different depending on the peripheral position. Thus, if the axial direction of photosensitive member is assumed to be in a lateral direction, charge unevenness in lateral stripes in synchronism with the AC frequency occurs. The pitch of the lateral stripes is $V_p/f$ (mm). When this pitch is larger than the pitch capable of developing by a developing device in an image forming apparatus, defective image occurs. To avoid this, therefore, it is necessary to increase the AC frequency f. For example, supposing an image forming apparatus having a printing speed of about four sheets of A4 format in vertical feed per minute (process speed 25 mm/s), the AC frequency is required to be 100 Hz or more.

In the case of an apparatus having a printing speed of about 30 sheets per minute (printing speed 190 mm/s), the AC frequency of over 750 Hz is required, but in this case the problem of charging noise occurs. In other words, by the AC frequency region in a range not to cause charging noise, the upper limit of the process speed of the image forming apparatus is determined. Accordingly, in the method of superposing DC voltage on AC voltage, it is hard to raise the printing speed.

Besides, an AC power source is large in volume and high in cost, which leads to larger size and higher cost of the image forming apparatus.

By contrast, when only the DC voltage is applied to the elastic roller, it is easy to raise the speed, the size is small and the cost is low, but, as mentioned above, the charging is uneven.

SUMMARY OF THE INVENTION

It is hence a primary object of the invention to present a charging device capable of operating at low voltage, by generating less ozone, and charging the material uniformly, and an image forming apparatus incorporating the same.

It is another object of the invention to present a charging device capable of charging the material uniformly in a constitution of small size and low cost, applicable to advanced process speed, and an image forming apparatus incorporating the same.

The invention comprises a moving object to be charged, a charging member to contact therewith, and a member for applying a DC voltage to the charging member. When the profile of the surface of the charging member near the contacting region of the charging member and the object to be charged is processed by space frequency spectrum analysis, its power spectrum PS satisfies the following relation, assuming the space frequency (or wave number) to be f.

If $10 \leqq f \leqq 100$ (cycles/mm):

$$PS \leqq -2.5 \times \log (f/2)\ (\mu m^2)$$

In the invention, since the object is charged by directly discharging between the charging member and the object to be charged, the ozone output is very small, and the applied voltage to the charging member may be kept low. At the same time, since the surface of the charging member is in the above range, uniform charging without charge unevenness is realized. By not using AC power, moreover, high speed charging is possible, and the apparatus is smaller in size and lower in cost.

Preferably, when surface undulations of the charging member are processed by space frequency spectrum analysis, the power spectrum should satisfy the following conditions.

If $f \leqq 7$ (cycles/mm):

$$\text{Log}\ (PS) \geqq -0.24f - 0.2\ (\mu m^2)$$

According to the invention, even at high temperature and high humidity, the charging member can be used stably for a long period without adhering to the object to be charged.

Effects and features of the invention will be better understood and appreciated in the following specific description and drawings including preferred embodiments.

DESCRIPTION OF THE PREFERRED EMBODIMENTS

Embodiment 1

Figure 1:
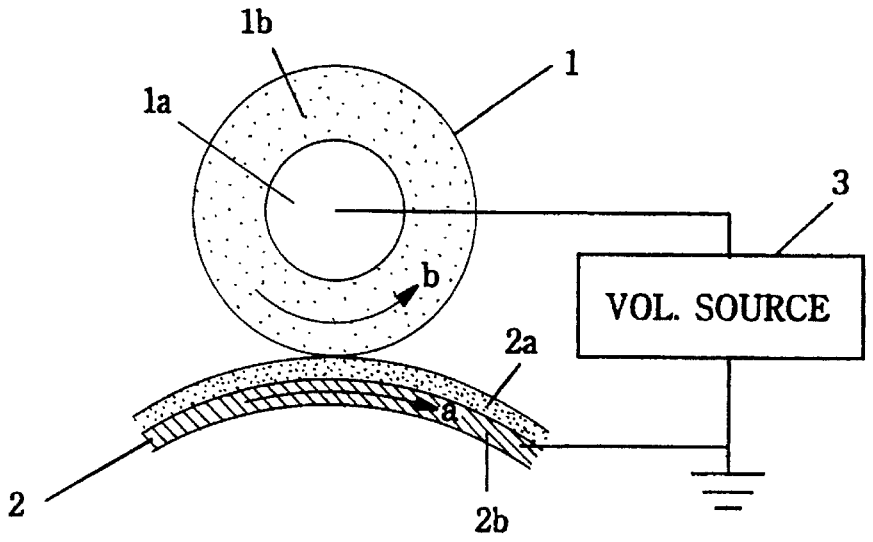
FIG. 1 is a sectional view of a charging device of the invention.

FIG. 1 is a schematic diagram of a charging device of the invention, which is referred to in the following description. In FIG. 1, reference numeral 1 is a semiconductive charging roller as charging member. The charging roller 1 is rotatably supported, and contacts with a photosensitive drum 2 as the object to be charged with a specific pressure. The photosensitive drum 2 has a photosensitive layer 2*a* (a layer composed of organic photoconductor, amorphous silicon, selenium, and other photoconductor) formed on a conductive substrate 2*b*, and rotates in a direction of arrow a at a specific speed. Accordingly, the charging roller 1 is driven and rotated in a direction of arrow b in the diagram along with rotation of the photosensitive drum 2. A DC voltage is applied to the charging roller 1 from a power source 3.

The charging roller 1 consists of a metallic core 1*a*, and a conductive elastic layer 1*b* formed thereon. This conductive elastic layer 1*b* is formed by dispersing conductive particles of carbon or the like or adding conductive substance such as inorganic metallic salts or the like to rubber of urethane, EPDM(ethylene-propylene-diene-methylene rubber), silicone, etc. The volume resistance of the conductive elastic layer 1*b* is preferred to be about $10^5$ to $10^{12}$ Ω.cm. If the resistance is too small, the electric charge supply capacity from the core 1*a* onto the surface of the conductive elastic layer 1*b* is heightened at the time of charging. Supposing there is a defect such as pin hole in the photoconductive layer 2*a*, the pin hole portion is extremely lower in resistance than the other portions on the photosensitive layer 2*a*. When the resistance of the conductive elastic layer 1*b* is low, the excessive current flowing in from the core 1*a* is concentrated in the pin hole area, and defective charging occurs, as a result, also in other portions than the pin hole. To the contrary, if the resistance is too high, the electric charge supply capacity from the core 1*a* onto the surface of the conductive elastic layer 1*b* is lowered at the time of charging, and charging cannot be done continuously. The electric charge supply capacity at this time is a general term comprising the mobility of electric charge inside the conductive elastic layer 1*b* and ease Of discharge of electric charge on the surface of the conductive elastic layer 1*b*. Depending on the composition of the rubber for forming the conductive elastic layer 1*b*, effects of temperature and humidity may act, but such effects are included in the range of the volume resistance mentioned above.

The rubber hardness of the conductive elastic layer 1*b* is preferred to be low for the sake of stable contact, and at least such a hardness as not to cause gap between the charging roller 1 and photosensitive drum 2 is required.

Since the conductive elastic layer 1*b* is made of rubber, the plasticizer or low molecular rubber may exude from inside to surface depending on the material or rubber hardness. It deposits on the surface of the photosensitive drum 2, and affects the characteristic (especially photosensitive characteristic) of the photosensitive layer 2*a*. Therefore, a surface layer for preventing the oozing of such substance may be further formed on the conductive elastic layer 1*b*. The surface layer may be formed of nylon resin, urethane resin or other resin layer, or if necessary, conductive particles are dispersed inside the surface layer to adjust the resistance.

With the above description of the charging device, the operation and features are described below.

Figure 2:
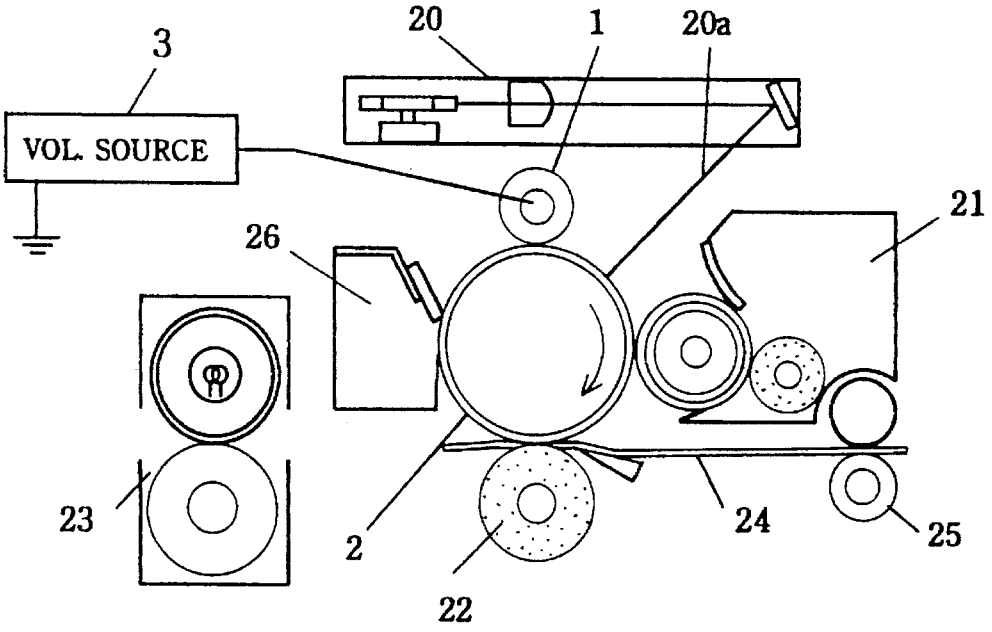
FIG. 2 is a sectional view showing a schematic of an image forming apparatus of the invention.

FIG. 2 is a diagram of an image forming apparatus incorporating the charging device of the invention. In FIG. 1 and FIG. 2, the charging roller 1 is composed of a stainless steel core 1*a* of 6 mm in outside diameter, and a conductive elastic layer 1*b* made of urethane rubber of 3 mm in thickness. The volume resistivity of the conductive elastic layer 1*b* is $10^6$ Ω.cm, and the rubber hardness is 50° (JIS A hardness; specified in JIS K 7215). A DC voltage ($V_c$) of −110 V is applied to the charging roller 1 from the power source 3. The photosensitive drum 2 is composed of a conductive substrate 2*a* of aluminum of 30 mm in outside diameter, and a photosensitive layer 2*b* of 20 μm in thickness made of organic photoconductor. The photosensitive drum 2 is rotated and driven in the direction of arrow in the diagram at a peripheral speed of 25 mm/s. In a developing device 21, magnetic one-component negative charge toner of mean particle size of about 8 μm is used. The operation of this image forming apparatus is briefly described below.

In the first place, by the charging roller 1 applied with a voltage from the power source 3, the surface of the photosensitive drum 2 is charged to a specified negative potential ($V_o$). Afterwards, the photosensitive drum 2 is exposed selectively depending on the image signal by laser beam 20*a* from a laser scanning unit (LSU) 20. As a result, an electrostatic latent image is formed on the photosensitive drum 2 in which the potential is lowered only in the exposed area (that is, the absolute value of the potential is lowered, and it is meant the same thereafter). Next, in a developing device 21, the negatively charged toner is deposited on the photosensitive drum 2 depending on the pattern of the electrostatic latent image. This developing device operates in the principle of reversal development to develop by depositing toner in the low potential area of the electrostatic latent image, that is, in the area exposed by the laser beam (developing bias potential: $V_B$=−350 V). By inverting the toner charging polarity, meanwhile, it is also possible to employ the normal development of depositing toner in the higher potential area. The toner image formed on the photosensitive drum 2 by the developing device 21 is transferred onto a paper 24 which is a transfer material by a next transfer roller 22. The paper 24 is fed by a resist roller 25 at such timing as to establish a specific configuration of the beginning of the image portion and the front end position of paper at the transfer position. The paper 24 on which the toner image is transferred is separated from the photosensitive drum 2, and is directly sent into a fusing device 23. When heated and fixed herein, the toner image is firmly adhered to the paper 24, and the image is formed. On the other hand, the surface of the photosensitive drum 2 is cleaned of the toner remaining on the surface after transfer by a cleaning device 26, and is charged again by the charging device. Thereafter, repeating this operation, the images are formed continuously.

Various experiments are executed as follows. First, the image forming apparatus shown in FIG. 2 was combined with a conventional charging device using a charging roller, and images were formed. As a result, favorable images were obtained in the normal temperature, normal humidity environments: NN environments (room temperature: 20° C., humidity: 50%), and high temperature, high humidity environments: HH environments (33° C., 80%). However, when evaluated in the low temperature, low humidity environments: LL environments (7° C., 20%), fog of tiny spots (50 to 500 μm in diameter) was formed on a white background, and similar white spots (50 to 500 μm in diameter) were formed in a black background.

Accordingly, it was impossible to measure the unevenness of the charge distribution directly. Therefore, by shifting up and down the developing bias voltage $V_B$, the potential unevenness was indirectly evaluated by varying the occurrence of fog and white spot. As a result, when the absolute value of $V_B$ was raised, both fog and white spot decreased, and when $V_B$ was lowered, both fog and white spot increased. It was hence clarified that the fogs max be caused by the development of reversely charged toner (that is, positively charged toner) in the developing device in an excessively charged position than the mean $V_o$. Such a phenomenon is verified by another method. When the polarity of the toner adhered on the photosensitive drum 2 is measured by Faraday-Cage method, reversely charged toner was adhered. The cause of occurrence of such abnormal image (or charging unevenness) depends on the surface roughness of the elastic roller as described below.

In direct charging to charge by contact of the photosensitive member which is the object to be charged and the charging roller which is a charging member, it is not to charge in the contact area, but to charge by the discharge occurring due to insulation breakdown of the air in a tiny gap near the contact area. Therefore, if the surface of the elastic roller is heavily undulated, the electric field is likely to concentrate in the convex area, and an excessive electric charge is released to cause abnormal discharge, which results in uneven charging. It is considered to lead to abnormal image such as fog and white spot. And generally, the surface roughness is evaluated by ten-point mean surface roughness (Rz: specified in JIS B 0601). However direct relation between the magnitude of Rz value and incidence of fog due to uneven charging was not recognized in the studies by the inventors.

Hence, we assumed the surface profile for expressing the degree of undulations of the charging roller surface to be a synthesis of periodic waves, and we noticed the power spectrum obtained by spectrum analysis of its space frequency and employed it.

To obtain Rz and power spectrum, the following measurement and calculation were conducted.

Rz Measurement (1) The charging roller 1 is set on the measuring stand of contact type surface roughness measuring instrument (Surfcom 550A: made by Tokyo Seimitsu).

(2) As the surface roughness measuring specification, the measuring length of 4 mm, probe moving speed of 0.3 mm/s, and cut-off value of 0.8 mm are set in the axial direction of the charging roller 1.

(3) A total of 9 points are measured in the middle and near both ends at intervals of 120 degrees on the circumference, and the mean value is calculated to obtain Rz of the charging roller 1.

Calculation of Power Spectrum (1) Using the same instrument as in Rz measurement, the sectional curve of the charging roller surface (amplitude unit μm) is measured, and the sectional curve data is A/D converted to obtain discrete data (the sampling frequency is 100 Hz).

(2) After Hanning window processing, FFT (fast Fourier transform) is processed (bandwidth: 0.65 cycle/mm).

(3) The mean of 9 points is calculated same as in Rz, and is obtained as the power spectrum of the charging roller 1.

In this image forming apparatus, the charging device using charging rollers of various degrees of surface roughness was incorporated to evaluate the performance. The evaluation consisted of image evaluation in LL environments (presence or absence of fog), and stickiness evaluation in HH environments in which stickiness (adhesion or fixing ) of contact parts of charging roller and photosensitive member is likely to occur.

Eight samples of charging roller 1 were prepared by mechanically polishing the surface to adjust so that Rz and power spectrum be vary independently.

In image evaluation, absence of fog was rated o and presence was X. Absence of stickiness was O, slight but harmless stickiness was Δ, and presence of stickiness was X.

The relation between thus obtained Rz and PS of charging roller 1 and output image was determined, and the surface roughness of the charging roller 1 necessary for uniform charging was judged. As a result of measurement and calculation, in the region of space frequency f>100 cycles/mm, there was almost no difference in power spectrum due to difference of roller. The result of evaluation is recorded in Table 1. In Table 1, the PS is the value in the condition of 10≦f≦100 cycles.

TABLE 1

| PS ($\mu m^2$) | Rz (μm) | Image evaluation (fog) | Stickiness |
|---|---|---|---|
| PS ≦ −2.5 × log(f/2) | 1.0 | ○ | X |
| PS > −2.5 × log(f/2) | " | X | X |
| PS ≦ −2.5 × log(f/2) | 3.0 | ○ | Δ |
| PS > −2.5 × log(f/2) | " | X | Δ |
| PS ≦ −2.5 × log(f/2) | 5.0 | ○○ | |
| PS > −2.5 × log(f/2) | " | X | ○ |
| PS ≦ −2.5 × log(f/2) | 10.0 | ○ | ○ |
| PS > −2.5 × log(f/2) | " | X | ○ |

Hence, as far as the space frequency f of the surface undulations of the charging roller 1 is in a range of 10≦f≦100 cycles/mm, in the condition of $$PS \leqq -2.5 \times \log(f/2)\ (\mu m^2)$$

uniformity of charging is maintained, and fog does not occur. Besides, by keeping $$Rz \geqq 5\ (\mu m)$$

stickiness can be also avoided.

When the surface of the charging roller 1 is smooth (which means the value of Rz is small), and the PS at each space frequency is a minus infinity, a uniform charging is realized. However, if the surface is too smooth, the contact between the photosensitive member 2 having a smooth surface and the charging roller is very tight, and stickiness phenomenon occurs. The stickiness is particularly manifest in the environments of high temperature and high humidity where the hardness of the elastic roller is lowered and tackiness of the surface is raised, and when the stuck charging roller 1 and photosensitive member 2 are driven by force, peeling of the photosensitive layer 2*a* or damage of the surface of the charging roller 1 may be induced. When the photosensitive layer 2*a* is an inorganic photosensitive layer of selenium, amorphous silicon, zinc oxide or the like, the contact with the base substrate 2*b* is tight, and peeling is hardly caused, but in the case of organic photosensitive layer, the contact with the substrate 2*b* is weak, and film strength is also weak, and it may be easily peeled off.

The conditions of PS and Rz seem to be contrary to each other, but actually what contributes to the value of Rz is the value of the power spectrum where the space frequency f is in a region of 10 cycles/mm or less. To the contrary, in a range of f≧10 cycles/mm, the value of Rz and value of power spectrum are hardly related with each other. As mentioned above, since the value of Rz and image are not directly related, the range of the space frequency affecting the charge unevenness is 10 cycles/mm or more and 100 cycles/mm or less. The profile of the surface shape of the charging roller 1 used in the embodiment is shown in the graph in FIG. 3, and the relation between the PS and space frequency f of the surface of the charging roller 1 at this time is shown in the graph in FIG. 4, and the basic concept of the invention is briefly described below while comparing the surface shape satisfying both Rz and PS and the surface shape not satisfying both.

Figure 3A:
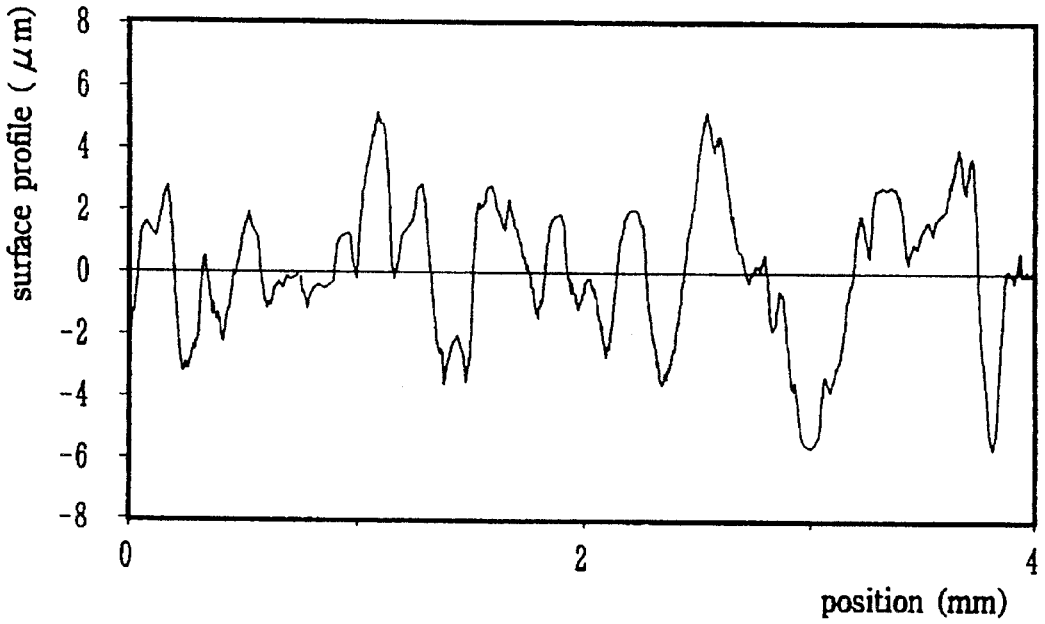
FIGS. 3*a* and 3*b* are diagrams showing a surface profile of charging member used in the charging device of the invention.
Figure 3B:
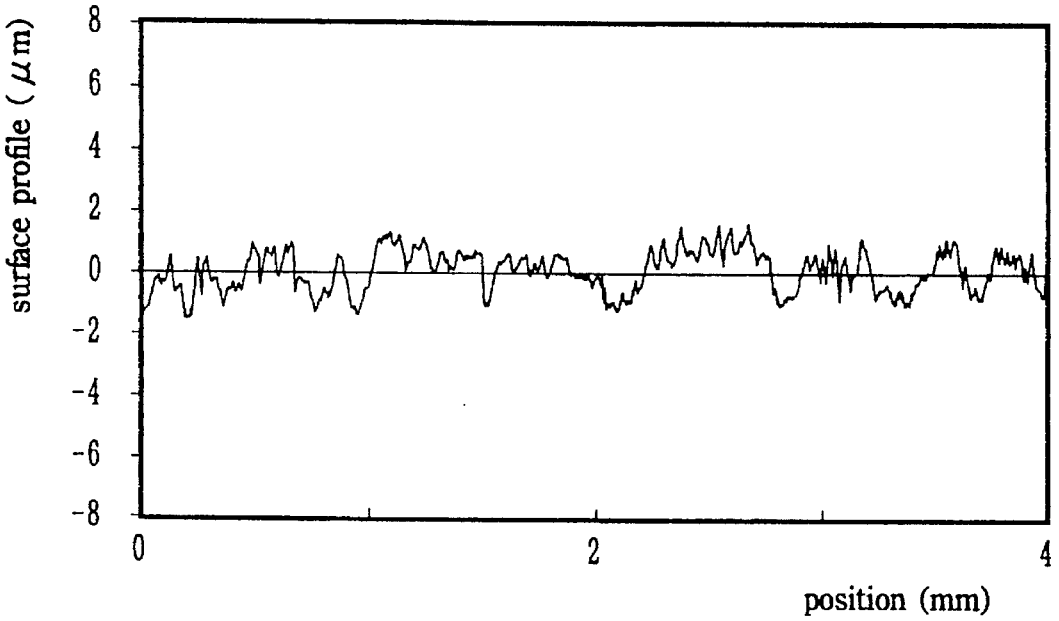

FIG. 3*a* is a graph showing a profile of surface roughness of the surface of the charging roller 1 not causing fog. To the contrary, FIG. 3*b* is a graph showing a profile of surface roughness of the charging roller 1 causing fog. The surface roughness of ten-point mean is respectively Rz=9.6 μm and Rz=2.9 μm. In a magnified observation of the surface by a microscope or the like, the charging roller 1 of a shows a smooth wave pattern, while the charging roller 1 of b discloses a ripple pattern. Judging by the value of Rz alone, the charging roller 1 of a is larger in charge unevenness, and fog is likely to occur. However, abnormal discharge seems to occur in the charging roller 1 of b having sharp edges.

Figure 4A:
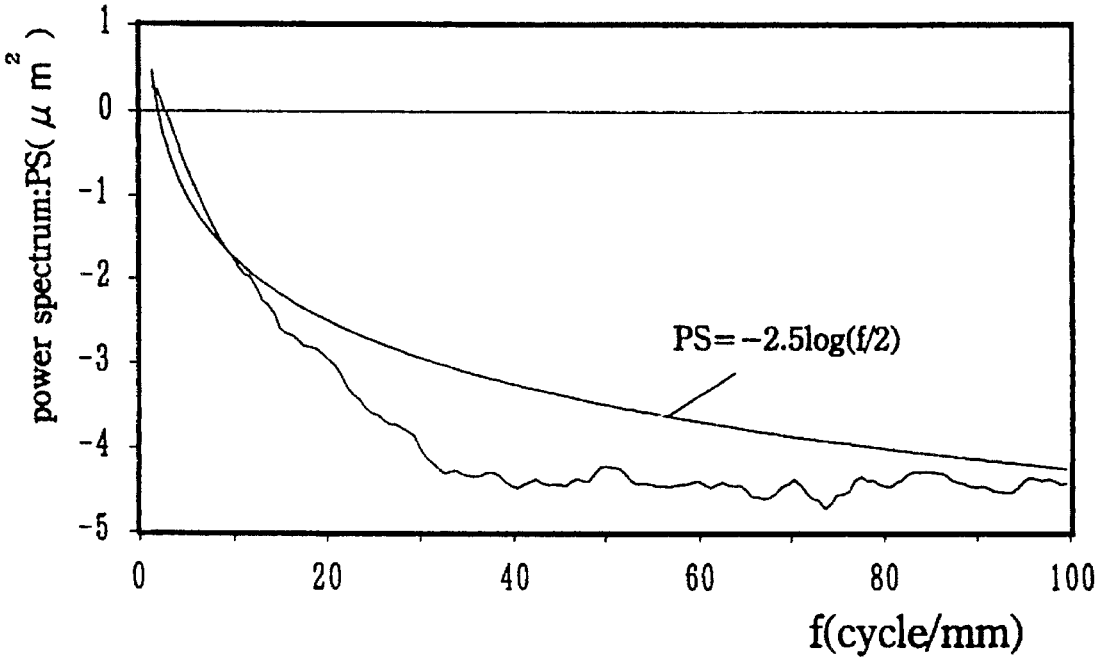
FIGS. 4*a* and 4*b* are diagrams showing a power spectrum of space frequency analysis of surface profile of charging member used in the charging device of the invention.
Figure 4B:
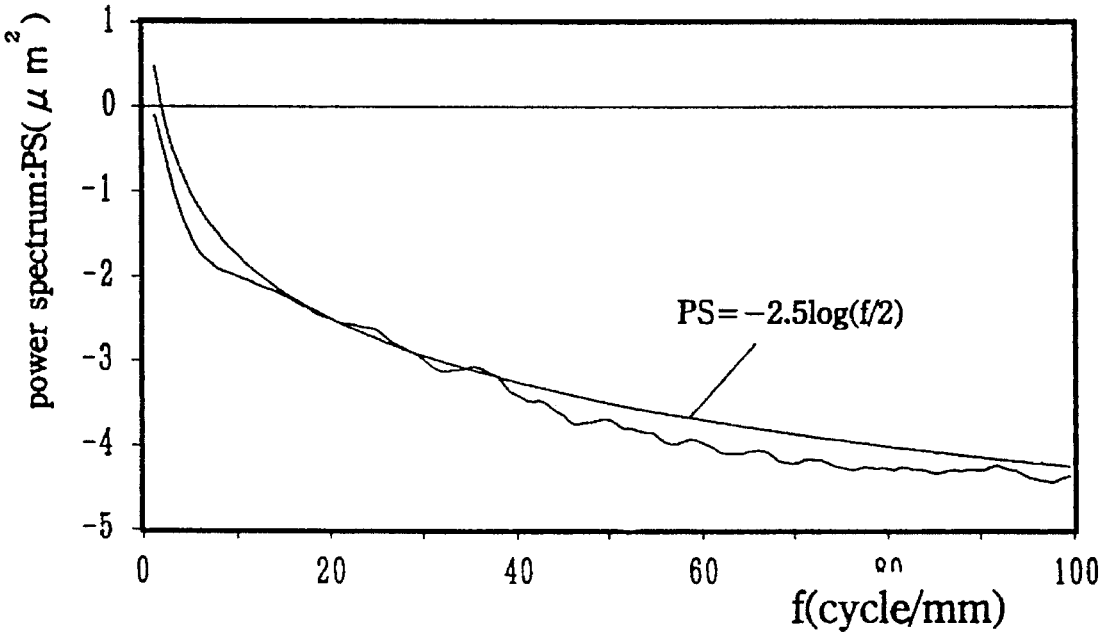

FIGS. 4*a* and 4*b* are graphs calculating the PS with respect to the space frequency f from the profiles of surface roughness shown in FIGS. 3*a* and 3*b*.

In the charging roller 1 of a appearing to be smooth on surface, in FIG. 4*a*, although the PS is large at the low frequency side, the PS is a small value in a range of f≧10 cycles/mm.

By contrast, in the charging roller 1 of b having sharp edges on the surface, in FIG. 4*b*, the value of PS is small at the low frequency side, but the PS has a large value in a range of f≧10 cycles/mm, indicating that the undulations are significant at the high frequency side.

FIGS. 4*a* and 4*b* simultaneously unveil the curves showing the relation between PS and fog as summarized in Table 1. The charging roller 1 having the PS value above the curve causes fog, while the charging roller 1 having all PS values below the curve is free from fog.

The criterion classified by stickiness is described below. As mentioned above, in the narrow range of space frequency of 10 cycles/mm, the PS value of power spectrum does not affect the charge unevenness so much, and the relation with Rz is closer. Therefore, the power spectrum PS value in this region seems to be related with ease of stickiness. From this viewpoint, the samples shown in Table 1 were evaluated of PS in a range of f<10 (cycles/mm), and it was known that stickiness can be avoided by satisfying the following condition.

$$\text{LOG}(P) \geqq -0.24f - 0.2\ (\mu m^2)$$

where $f \leqq 7$ (cycles/mm)

In the embodiment, DC voltage is applied to the charging roller 1, but a composite voltage of AC voltage superposed on DC voltage may be also applied. In such a case, the tolerance for deposits on the roller may be further widened as compared with the case of applying only DC voltage, and the charging device and image forming apparatus of longer life can be presented. Incidentally, the charging roller 1 is driven and rotated in the embodiment, but it may be driven independently as far as the rotation is uniform in speed. At this time, surface damage likely to occur on the charging roller 1 or photosensitive drum 2 surface when possessing peripheral speed difference does not take place. However, depending on the material selection and performance of other processes of developing, transfer and cleaning, surface damage does not always occur if there is a peripheral speed difference, and a peripheral speed difference may be allowed in a same rotating direction, or the charging performance is maintained if rotating in opposite direction, so that the selection may be free.

Embodiment 2

Figure 5:
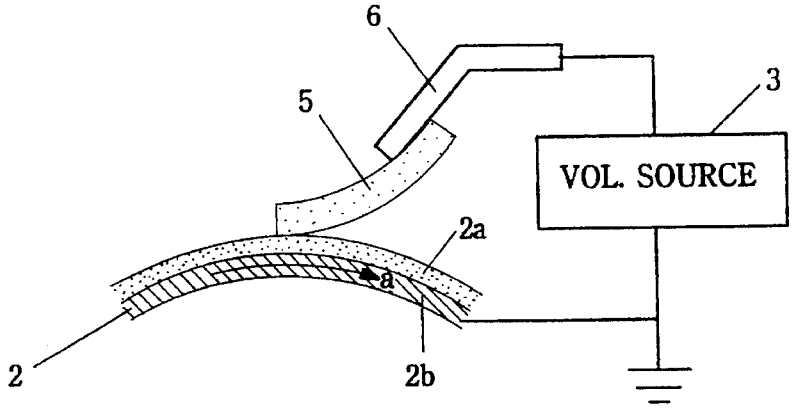
FIG. 5 is a sectional view of a charging device of the invention.

FIG. 5 shows a charging device using a semiconductive charging blade, instead of the charging roller 1 in the first embodiment.

In FIG. 5, the charging blade 5 is elastic, and its one end is fixed to a conductive holding member 6. The other end contacts with the photosensitive drum 2 with a specific pressure. One end of the charging blade 5 is fixed to the holding member 6, and DC voltage is applied to the other end of the charging roller 5 from a power source 3 through the holding member 6.

The charging blade 5 is manufactured by forming the semiconductor rubber used in embodiment 1 in a plate form, and its volume resistance is $10^8$ Ω.cm, thickness is 2 mm, and projection length from the holder 6 is 10 mm.

In FIG. 5, the contact state of the charging blade 5 and photosensitive member 2 is in leading direction, but it may be in trailing direction. By press contacting in the trailing direction, the frictional force between the photosensitive member 2 and charging blade 5 decreases, which may contribute to decrease of stick slip (uneven contact due to small vibrations of blade, cause of unusual noise) and wear of photosensitive layer 2*a*, which were problems in pressing a blade against the photosensitive member 2.

Using this charging blade 5, image evaluation and stickiness evaluation were conducted in the same manner as in embodiment 1. The results are shown Table 2.

TABLE 2

| PS ($\mu m^2$) | Rz (μm) | Image evaluation (fog) | Stickiness |
|---|---|---|---|
| PS ≦ −2.7 × log(f/2) | 1.0 | ○ | X |
| PS > −2.7 × log(f/2) | " | X | X |
| PS ≦ −2.7 × log(f/2) | 3.0 ○ | Δ | |
| PS > −2.7 × log(f/2) | " | X | Δ |
| PS ≦ −2.7 × log(f/2) | 5.0 | ○ | ○ |
| PS > −2.7 × log(f/2) | " | X | ○ |

TABLE 2-continued

| PS ($\mu m^2$) | Rz (μm) | Image evaluation (fog) | Stickiness |
|---|---|---|---|
| PS ≦ −2.7 × log(f/2) | 10.0 | ○ | ○ |
| PS > −2.7 × log(f/2) | " | X | ○ |

Thus, by defining the PS and Rz value of the charging blade 5 within the range specified in the first embodiment, favorable images are obtained, and stickiness can be avoided.

The evaluation result by charging roller 1 is shown in embodiment, and that by charging blade 5 in embodiment 2, and similar effects are obtained whether the charging member is charging belt or charging block.

Embodiment 3

Figure 6:
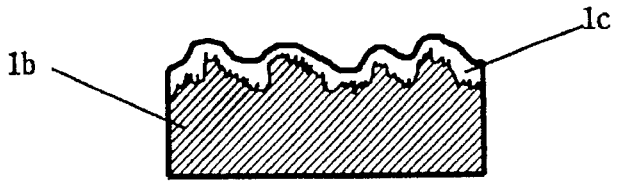
FIG. 6 is a sectional view of a charging member used in the charging device of the invention.

FIG. 6 shows a schematic sectional view of a charging roller 1 in a third embodiment of the invention. The charging roller 1 shown in FIG. 6 is prepared by coating the surface of the charging roller used in embodiment with urethane paint.

In embodiment 1, the surface state of the condition presented in the invention is realized by polishing the surface of the elastic layer 1*b*. To satisfy, however, the presented condition of the invention by polishing process alone is not suited to mass production because setting of control and processing condition of the process is very complicated and it is expensive per piece in the aspect of processing time and yield. It is hence attempted to shorten the processing time, enhance the yield, and improve prevention of leak into the photosensitive member 2, by coating the surface of the charging roller 1 after rough polishing with a urethane paint of the same material as the elastic layer 1*b* to form a resistance layer 1*c*.

As shown in FIG. 6, there is a polishing flaw by complicated polishing process consisting of large undulations and small undulations in the base area of the charging roller 1. A urethane paint is applied thereon to form an appropriate film thickness. As a result, the resistance layer 1*c* is apt to leave the original configuration against the large undulations, and fills gaps and rounds the tops of bulge of the small undulations. Therefore, as converted to the space frequency f as the cause of abnormal discharge, undulations in a range of $10 \leqq f \leqq 100$ cycles/mm are smoothed out as compared with the levels before application of urethane paint, and the PS is lowered. As for undulations with the space frequency f of below 10 cycles/mm effective for prevention of stickiness, the surface shape of the elastic layer 1*b* is left over almost completely.

Using thus urethane coated charging roller 1, the same image evaluation and stickiness evaluation as in the first embodiment were conducted. As a result, in the charging roller 1 satisfying the condition in the first embodiment, the same result as in the first embodiment was obtained.

In the embodiment, the elastic layer 1*b* was urethane rubber, and the resistance layer 1*c* was coated with urethane paint, but they are not limitative, and the elastic layer material may be silicone rubber, EPM, EPDM, chloroprene rubber, or any other elastic material, which may be used as the elastic layer 1*b* after semiconductive treatment. As the resistance layer material, polyamide, polyester, fluoroplastics, silicon resin, acrylic resin, or other material capable of forming a resistance layer in a paint form can be used as the resistance layer 1*c*.

The embodiment relates to the constitution of the charging roller 1, but it is not limited to the roller alone, and it is clear from the technical concept of the invention that the same performance is obtained in the charging member in blade, belt or block form.

Embodiment 4

A fourth embodiment is shown. The fourth embodiment is different from the first embodiment in that the ten-point mean surface roughness Rz and sum of power spectrum in predetermined frequency range are used as the scale for expressing the surface roughness of the charging roller 1. That is, instead of the power spectrum in the first embodiment, the sum of power spectrum in predetermined frequency range is used.

Figure 7:
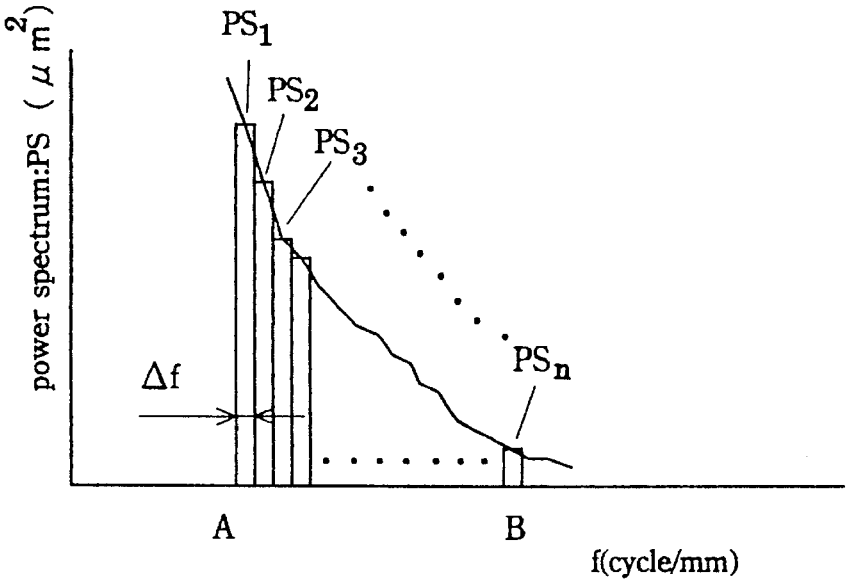
FIG. 7 is a conceptual diagram for explaining the sum of power spectrum in predetermined frequency range by space frequency analysis of surface profile of charging member used in the charging device of the invention.

The sum of power spectrum in predetermined frequency range and the related integral value are explained below by using power spectrum curve. A space frequency range is specified as in A, B in FIG. 7 (in this invention, from 10 cycles/mm to 50 cycles/mm), and this range is divided into n pieces in every bandwidth Δf (cycles/mm), and the power spectrum $PS_i$ is calculated in every bandwidth (i=1, 2, . . . ,n) ($\mu m^2$)

$$\Delta f \cdot \sum_{i=1}^{n} PS_i,$$

which corresponds to the area of the power spectrum curve between A and B.

On the other hand, the sum of power spectrum in predetermined frequency range can be expressed as $$\sum_{i=1}^{n} PSi.$$

In various elastic rollers, the integral values of the power spectrum were obtained from the space frequency of 10 cycles/mm to 50 cycles/mm, and spotty fog and white spot occurred at the power spectrum integral value of 0.07 or higher, and more strictly, when the power spectrum integral value was 0.05 or higher, occurrence of fog was observed depending on the developing process.

It was hence known possible to determine the threshold of surface roughness of the charging member for uniform charging by the integral value of power spectrum. However, the threshold value of 0.07 as the integral value of power spectrum-is valid only on the power spectrum value calculated in the bandwidth of the specified condition (0.65 cycle/mm) in FFT processing. When the power spectrum value and integral value are calculated in a different bandwidth, with the threshold value of 0.07 in above condition (bandwidth: 0.65 cycle/mm cannot be applied directly). The calculated integral value of power spectrum must be divided by the bandwidth at the time of FFT processing, and further multiplied by the bandwidth (0.65 cycle/mm).

By contrast, the sum of power spectrum in predetermined frequency range can be compared mutually, within a same space frequency range, whether the sectional curve is measured in different conditions, or the power spectrum value is calculated in different bandwidths in respective elastic rollers in different FFT treating conditions. It is hence a mote effective parameter for setting the threshold of the surface roughness of charging member for uniform charging.

The measuring method and calculating method of sum of power spectrum in predetermined frequency range are described below.

Calculation of Power Spectrum, and Sum of Power Spectrum in Predetermined Frequency Range (1) Using the same instrument as in Rz measurement, sectional curves (amplitude unit μm) in the circumferential direction and axial direction of charging roller surface are measured, the sectional curve data are A/D converted, and discrete data are obtained (sampling frequency 100 Hz).

(2) After Hanning window processing, FFT (fast Fourier transform) is processed (bandwidth 0.65 cycle/mm).

(3) Same as in Rz, the mean of nine points is calculated in the circumferential direction and axial direction, and the power spectrum in the circumferential direction and axial direction of the charging roller 1 is obtained.

(4) The sum in the predetermined frequency range is calculated by accumulating the power spectrum PS values in each space frequency in the predetermined space frequency range of the obtained power spectra (in the case of the invention, 10 cycles/mm≦f≦50 cycles/mm, where f: space frequency).

Same as in the third embodiment, ten samples of charging roller 1 adjusting Rz and PS independently by coating were prepared, and evaluated same as in the first embodiment. The result of evaluation is shown in Table 3. In table 3, Δ in image evaluation denotes, that slight fog appearred not to be a problem in practical use.

TABLE 3

| Sum of power spectrum between 10 and 50 cycles/mm ($\mu m^2$) | Ten-point mean surface roughness (μm) | Image evaluation | Stickiness |
|---|---|---|---|
| ≦0.11 | 1 | ○ | X |
| | 3 | ○ | Δ |
| | 5 | ○ | ○ |
| | 7 | ○ | ○ |
| | 10 | Δ | ○ |
| >0.11 | 1 | X | X |
| | 3 | X | Δ |
| | 5 | X | ○ |
| | 7 | X | ○ |
| | 10 | X | ○ |

Figure 8A:
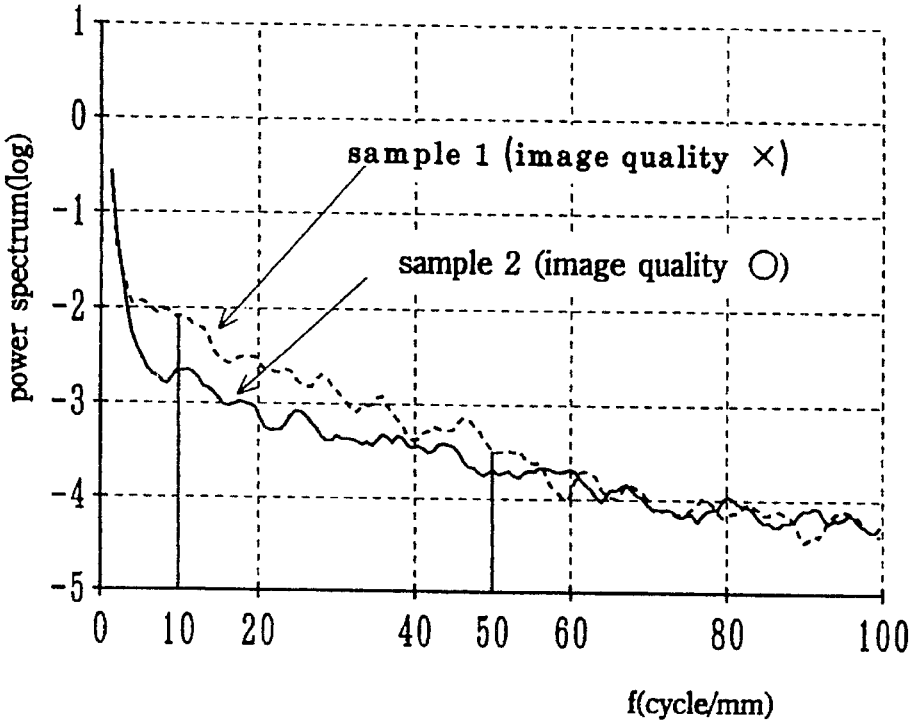
FIGS. 8*a* and 8*b* are diagrams showing the power spectrum by space frequency analysis of surface profile of charging member used in the charging device of the invention.
Figure 8B:
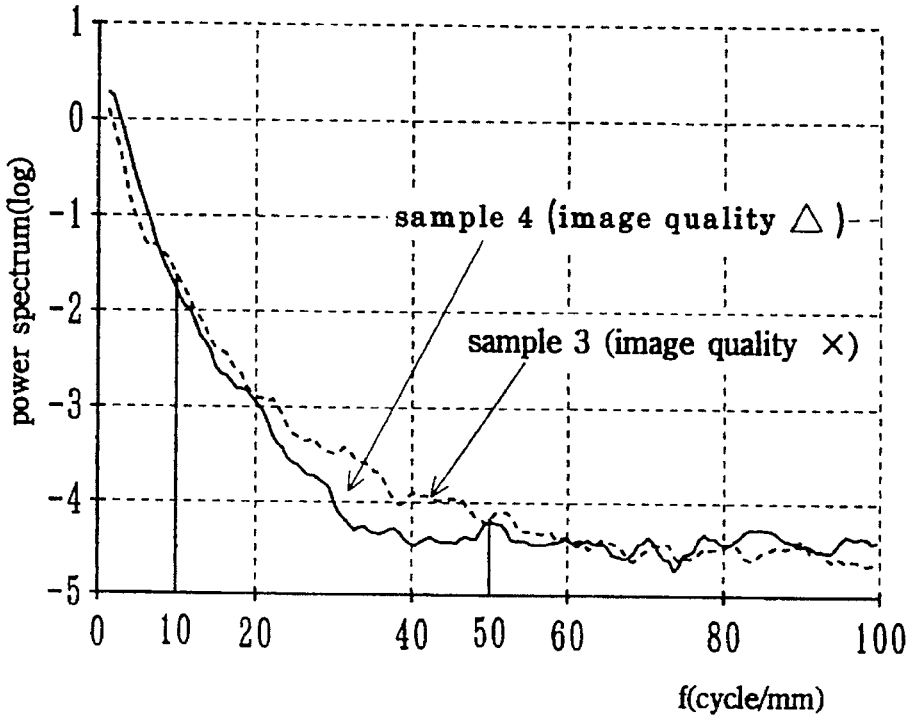

FIG. 8(*a*) shows the relation between the power spectrum and space frequency in comparison of two samples in Table 3, that is, the charging roller (sample 1) with the sum of power spectrum being more than 0.11 μm2 and Rz being 3 μm, and charging roller (sample 2) with the sum being 0.11 $\mu m^2$ or less and Rz being 3 μm, and FIG. 8(*b*) shows the relation between power spectrum and space frequency, in the charging roller (sample 3) with the sum of power spectrum being more than 0.11 $\mu m^2$ and Rz being 10 μm, and charging roller (sample 4) with the sum being 0.11 $\mu m^2$ or less and Rz being 10 μm.

Figure 9:
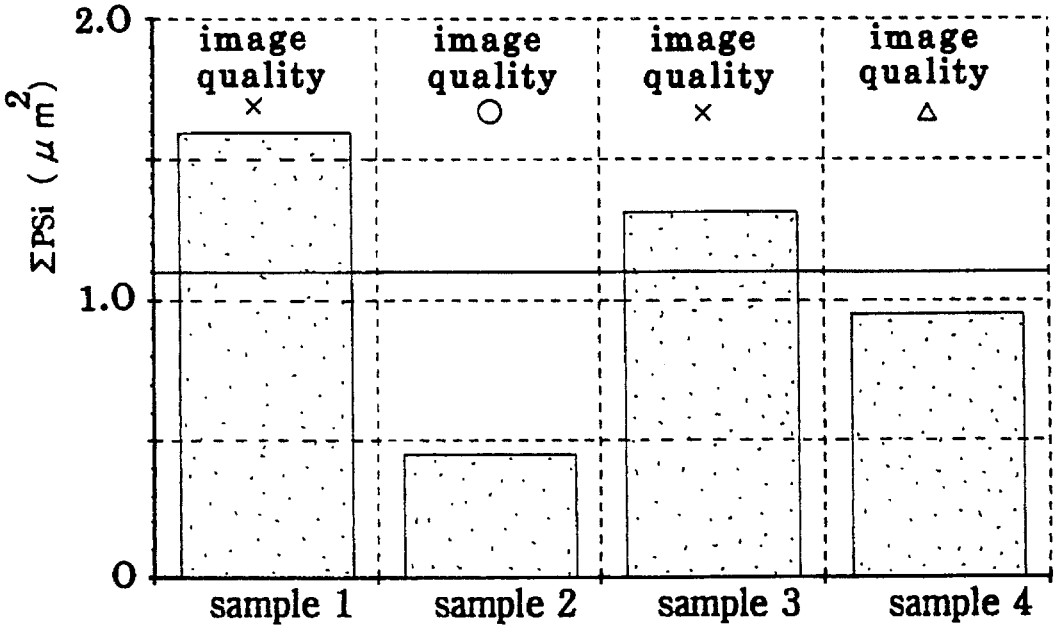
FIG. 9 is a diagram showing the sum of power spectrum in predetermined frequency range by space frequency analysis of surface profile of charging member used in the charging device of the invention.
Figure 10A:
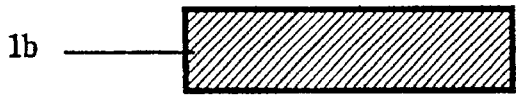
FIGS. 10*a*–10*d* are conceptual diagrams showing a manufacturing method of charging member used in the charging device of the invention.
Figure 10B:
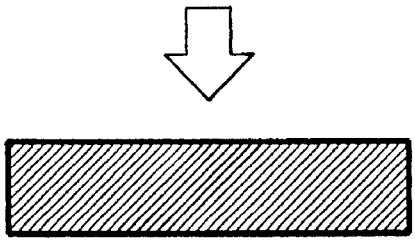
Figure 10C:
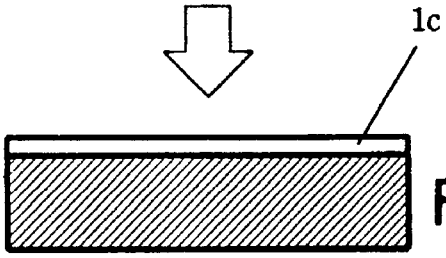
Figure 10D:
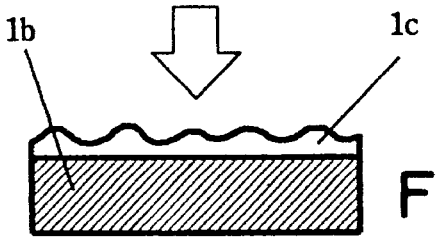

As clear from FIGS. 8(*a*), (*b*), in any case, the difference in the power spectrum in the space frequency range of 10 cycles/mm to 50 cycles/mm appears in the difference of good or poor image. The sum of power spectrum in the space frequency range of 10 cycles/mm to 50 cycles/mm in these four samples is given in FIG. 9. As evident from Table 3 and FIG. 9, when the sum of power spectrum is greater than 0.11 $\mu m^2$, excellent image cannot be obtained. When the sum is 0.11 $\mu m^2$ or less, a practically fair image is obtained, and further when the sum is 0.08 $\mu m^2$ or less, a more favorable image can be obtained.

Incidentally, the stickiness between the charging roller 1 and photosensitive member 2 can be avoided, as clear from Table 3, by defining the Rz of the charging roller surface at 5 μm or more.

Moreover, same as in the first embodiment, the power spectrum was evaluated in the space frequency affecting the stickiness in a range of 10 cycles/mm or less was evaluated. As a result, at the space frequency f in a range of 10 cycles or less, it is known that stickiness does not take place when the sum of power spectrum $\Sigma PS_i$ is 0.8 $\mu m^2$ or more.

In the embodiment, a rotary roller was used as the charging member, but it is evident that the same effects are obtained with non-rotating roller, blade, block, or the like.

Embodiment 5

A fifth embodiment is shown. The fifth embodiment is different from the first embodiment that the ten-point means surface roughness and recess distance relative to bulge distance of surface are used as the scale for expressing the surface roughness of the charging roller 1. That is, instead of the power spectrum in the first embodiment, the recess distance relative to bulge distance of surface is used.

By coating, same as in the third embodiment, the charging roller 1 is adjusted so that the depth and Rz of recesses differ in the surface bulge distance in a range of 10 to 100 μm. Using various charging rollers, the same evaluation as in the first embodiment was conducted. The result of evaluation is shown in Table 4.

TABLE 4

| Recess depth | Rz (μm) | Image evaluation | Stickiness |
|---|---|---|---|
| ⅕ | 1.0 | ○ | X |
| ½ | | ○ | X |
| ¾ | | ○ | X |
| 1/1 | | X | Δ |
| ⅕ | 3.0 | ○ | ○ |
| ½ | | ○ | Δ |
| ¾ | | ○ | ○ |
| 1/1 | | X | ○ |
| ⅕ | 5.0 | ○ | ○ |
| ½ | | ○ | ○ |
| ¾ | | Δ | ○ |
| 1/1 | | X | ○ |
| ⅕ | 10.0 | ○ | ○ |
| ½ | | ○ | ○ |
| ¾ | | Δ | ○ |
| 1/1 | | X | ○ |

As known from the result, between adjacent bulges of the charging roller 1, when the distance between bulges is in a range of 10 μm to 100 μm, and the depth of recesses is within ¾ of the bulge distance, charging is uniform, and fog does not occur. Besides, by keeping the Rz at 5 μm or more, stickiness can be avoided at the same time.

In the embodiment, a rotary roller is used as charging member, but same effects are obtained with non-rotating roller, blade, block, or the like.

Embodiment 6

A sixth embodiment is shown. In the third embodiment, the undulations of the elastic layer 1*b* were merely smoothed out by the resistance layer 1*c*. In this case, in order to prevent stickiness in the HH environments, it was necessary to process preliminarily the surface of the elastic layer 1*b* which is the base surface so that the power spectrum PS may be large in a range of f<10 cycles/mm. In this embodiment, a manufacturing method of charging roller not requiring such prior processing is explained by reference to FIG. 10.

Before applying the resistance layer 1*c* on the elastic layer 1*b*, the polished elastic layer 1*b* ((a) in diagram) is immersed in a volatile solvent, and the elastic layer 1*b* is swollen (b). After thus expanding the outside diameter of the elastic layer, the resistance layer 1*c* is applied (c). Before the volatile solvent in the elastic layer 1*b* evaporates, the resistance layer 1*c* is dried and cured, thereby forming a smooth film. When drying continues, the volatile solvent in the elastic layer 1*b* evaporates, so that the outside diameter shrinks to the original size. At this time, the resistance layer 1*c* adhered to the elastic layer 1*b* is compressed by shrinking of the elastic layer 1*b* so that the smooth film is corrugated (d). By thus manufacturing, it easily produces a charging roller which is smooth in the surface in the relatively high space frequency range influencing the charge unevenness, and large in roughness or Rz in the low frequency range influencing the stickiness.

When the shape and material of the charging roller 1 are same as in embodiment 1, alcohol or toluene not attacking the urethane rubber is used as the volatile solvent. The charging roller is immersed in the solvent for 30 seconds to 5 minutes, and immediately the urethane paint is applied in a film thickness of about 5 to 500 μm, preferably 10 to 50 μm. Then it is dried for 2 to 8 hours at about 100° C.

Using the charging rollers 1 fabricated according to the embodiment, the image evaluation and stickiness evaluation were conducted same as in embodiment 1, and the charging roller 1 satisfying the conditions of the invention produced the same result as in embodiment 1.

In the embodiment, the elastic layer 1*b* was made of urethane rubber and the resistance layer 1*c* was coated with urethane paint, but they are not limitative, and the elastic layer material may be silicone rubber, EPM, EPDM, chloroprene rubber, or any other elastic material, which may be used as the elastic layer 1*b* after semiconductive treatment. As the resistance layer material, polyamide, polyester, fluoroplastics, silicon resin, acrylic resin, or other material capable of forming a resistance layer in a paint form can be used as the resistance layer 1*c*.

The embodiment relates to the constitution of the charging roller 1, but it is not limited to the charging roller 1 alone, and it is clear from the technical concept of the invention that the same performance is obtained in the charging member in blade, belt or block form.

Embodiment 7

In the developing device 21 of the image forming apparatus in FIG. 2, when magnetic one-component developing device or the like is used, much reversely charged toner may be present in the developing device. In such a case, also in the image forming apparatus incorporating the charging device disclosed in the invention, image defects such as fog of lateral stripes or white spots may occur by image output, especially in the LL environments. This is caused by a small excessive charging of the photosensitive layer 2*a* at the upstream side (called approaching region) immediately before contact between the charging roller and photosensitive layer 2*a*, as disclosed in the Japanese Patent Application No. 5-221802 and U.S. patent application Ser. No. 08/302,068.

Figure 11:
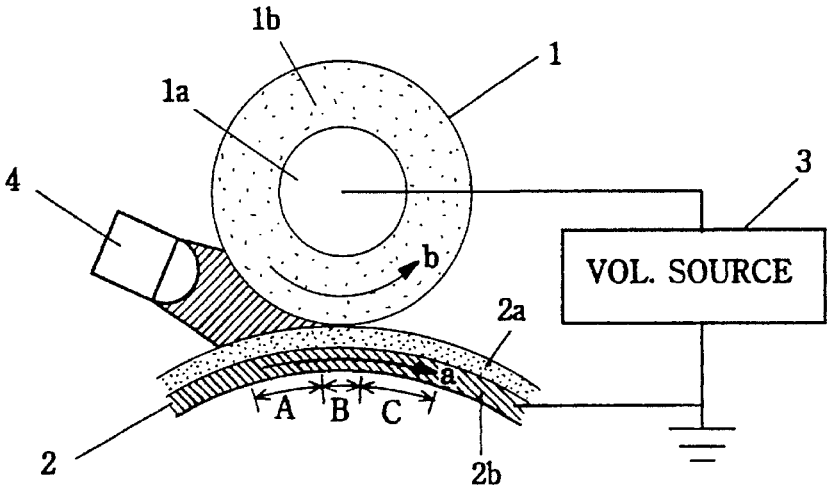
FIG. 11 is a sectional view of the charging device of the invention.

As a seventh embodiment, an example of charging device used in the image forming apparatus is shown in FIG. 11.

In FIG. 11, the region near the surface of the photosensitive drum 2 before and after the contact area of the charging roller 1 and photosensitive drum 2 is divided into the following three portions.

(1) A closing region (A) until the surfaces of the charging roller 1 and photosensitive drum 2 approach to each other and contact.

(2) A contacting region (B) where the surfaces of the charging roller 1 and photosensitive drum 2 contact with each other.

(3) Separating region (C) where the surfaces of the charging roller 1 and photosensitive drum 2 are mutually separating from each other.

In FIG. 11, reference numeral 4 denotes an LED for exposing the closing region indicated by A. The other constituent elements are same as in FIG. 1 and detailed descriptions are omitted. In this closing region, the electric charge moves from the charging roller 1 toward the drum 2 by the aerial discharge phenomenon, but the electric charge on the photosensitive layer 2*a* is gradually destaticized by the light of the LED 4. Until the charging roller 1 and drum 2 contact, electric charge is not accumulated on the surface of the photosensitive layer 2*a*, and the surface potential maintains the state of $V_o$=0 V. Next, in the contacting region, gap is not present, and the discharge phenomenon does not occur, thereby transferring to the next separating region. In the separating region, as the gap is gradually widened, discharge is resumed on the moment the conditions of gap distance and discharge start voltage are satisfied according to Paschen's law. Since this region is not exposed by the LED 4, the electric charge is accumulated on the surface of the photosensitive layer 2*a*, and the drum 2 is charged. In the separating region, since the gap distance upon start of discharge is short, abnormal discharge does not occur, so that defective image is not caused.

The charging device using the charging rollers in embodiments 1 to 6 was incorporated in the image forming apparatus of this embodiment, and the same evaluation as in embodiment 1 was conducted. As a result, the charging rollers satisfying the scope of the invention produced favorable results without fog or stickiness. Therefore, in the embodiment, even in the image forming apparatus with much reversely charged toner present in the developing agent, image abnormality such as fog of lateral stripes and white spot does not occur.

In the embodiment, excessive charging of the photosensitive layer is prevented by exposing the closing region, but this method is not limitative, and same effects are obtained by disposing a charging restriction means in the closing region as disclosed in U.S. patent application Ser. No. 08/302,068 mentioned above, or disposing the LED at the further upstream side by making use of the life of the pair carrier generated in the photosensitive layer.

In the embodiment, the charging member is a roller, but, not limited to the roller, evidently, the same effects are obtained with blade, belt, block, and the like.

In the embodiments 1 to 7, the object to be charged is not limited to the photosensitive member alone, and the invention may be effectively utilized in other objects, too.

In the all embodiments as a power source AC power can be utilized.

What is claimed is:

1. A charging device for charging a movable object to be charged, comprising:

a charging member which contacts the object to be charged, and a power source for applying a voltage to the charging member, wherein when a space frequency, f, of a profile of a surface of the charging member is analyzed, a power spectrum PS for a frequency higher than a predetermined frequency value is smaller than a predetermined power spectrum value.

2. A charging device of claim 1, wherein a ten-point mean surface roughness of the charging member surface is 5 μm or more.

3. A charging device of claim 1, wherein the charging member is a roller or a blade.

4. An image forming apparatus comprising:

a movable image carrier, and the charging device in accordance with claim 1, for charging the carrier.

5. A charging device for charging a movable object to be charged, comprising:

a charging member which contacts with the object to be charged, and a power source for applying a voltage to the charging member, wherein a power spectrum PS satisfies the following relation when a space frequency of a profile of a surface of the charging member is analyzed, in a section of $10 \leqq f \leqq 100$ (cycles/mm) (f: space frequency):

$$PS \leqq -2.5 \times \log (f/2)\ (\mu m^2).$$

6. A charging device for charging a movable object to be charged, comprising:

a charging member which contacts with the object to be charged, and a power source for applying a voltage to the charging member, wherein a power spectrum PS satisfies the following relation when a space frequency of a profile of a surface of the charging member is analyzed, wherein the power spectrum PS of the charging member surface satisfies the following relation:

in a section of $f \leqq 7$ (cycles/mm) (f: space frequency):

$$\mathrm{LOG}\ (PS) \geqq -0.24f - 0.2\ (\mu m^2).$$

7. A charging device for charging a movable object to be charged, comprising:

a charging member which contacts with the object to be charged, and a power source for applying a voltage to the charging member, wherein a power spectrum PS satisfies the following relation when a space frequency of a profile of a surface of the charging member is analyzed, in a section of $10 \leqq f \leqq 100$ (cycles/mm) (f: space frequency):

$$PS \leqq -2.5 \times \log (f/2)\ (\mu m^2), \text{ and further}$$

in a section of $f \leqq 7$ (cycles/mm) (f: space frequency):

$$\mathrm{LOG}\ (PS) \geqq -0.24f - 0.2\ (\mu m^2).$$

8. A charging device for charging a movable object to be charged, comprising:

a charging member which contacts the object to be charged, and a power source for applying a voltage to the charging member, wherein when a space frequency, f, of a profile of a surface of the charging member is analyzed, a sum of a power spectrum $\Sigma PS_i$ for a frequency higher than a predetermined frequency value is smaller than a predetermined sum of the power spectrum value.

9. A charging device of claim 8, wherein the ten-point mean surface roughness of the charging member surface is 5 μm or more.

10. A charging device of claim 8, wherein the charging member is a roller or blade.

11. An image forming apparatus comprising:

a movable image carrier, and the charging device in accordance with claim 8, for charging the carrier.

12. A charging device for charging a movable object to be charged, comprising:

a charging member which contacts with the object to be charged, and a power source for applying a voltage to the charging member, wherein when a space frequency of a profile of a surface of the charging member is analyzed, a sum of power spectrum ΣPSi in a predetermined frequency range satisfies the following relation, in a section of $10 \leqq f \leqq 50$ (cycles/mm) (f: space frequency):

$$\Sigma PS_i \leqq 0.11\ (\mu m^2).$$

13. A charging device for charging a movable object to be charged, comprising:

a charging member which contacts with the object to be charged, and a power source for applying a voltage to the charging member, wherein when a space frequency of a profile of a surface of the charging member is analyzed, a sum of power spectrum ΣPSi in a predetermined frequency range satisfies the following relation, in a section of $f<10$ (cycles/mm) (f: space frequency):

$$\Sigma PS_i \geqq 0.8\ (\mu m^2).$$

14. A charging device for charging a movable object to be charged, comprising:

a charging member which contacts with the object to be charged, and a power source for applying a voltage to the charging member, wherein when a space frequency of a profile of a surface of the charging member is analyzed, a sum of power spectrum ΣPSi in a predetermined frequency range satisfies the following relation, in a section of $10 \leqq f \leqq 50$ (cycles/mm) (f: space frequency):

$$\Sigma PS_i \leqq 0.11\ (\mu m^2),\ \text{and further}$$

in a section of $f<10$ (cycles/mm) (f: space frequency):

$$\Sigma PS_i \geqq 0.8\ (\mu m^2).$$

15. A charging device for charging a movable object to be charged, comprising:

a charging member which contacts the object to be charged, and a power source for applying a voltage to the charging member, wherein when a distance between adjacent bulges on a surface of the charging member is in a predetermined range, a depth of recesses on the surface of the charging member is smaller than a predetermined value derived from the distance between the bulges.

16. A charging device of claim 15, wherein the ten-point mean surface roughness of the charging member surface is 5 μm or more.

17. A charging device of claim 15, wherein the charging member is a roller or blade.

18. An image forming apparatus comprising:

a movable image carrier, and the charging device in accordance with claim 15, for charging the carrier.

19. A charging device for charging a movable object to be charged, comprising:

a charging member which contacts with the object to be charged, and a power source for applying a voltage to the charging member, wherein when a distance between adjacent bulges on a surface of the charging member is in a range of 10 to 100 μm, a depth of recesses is ¾ or less of the distance between bulges.

20. A charging device for charging a movable object to be charged, comprising:

a charging member which contacts with the object to be charged, and possesses a region approaching to and a region departing from the charging member, a charge preventive means for preventing a charging of the object at the approaching region, and a power source for applying a voltage to the charging member, wherein when a distance between adjacent bulges on a surface of the charging member is in a predetermined range, a depth of recesses is smaller than a predetermined value derived from the distance between bulges.

21. A charging device for charging a movable object to be charged, comprising:

a charging member which contacts with the object to be charged, and possesses a region approaching to and a region deparing from the charging member, a charge preventive means for preventing a charging of the object at the approaching regions, and a power source for applying a voltage to the charging member, wherein when a space frequency of a profile of a surface of the charging member is analyzed, a power spectrum PS in a higher frequency (f: space frequency) than a perdetermined frequency value is smaller than a predetermined power spectrum value.

22. A charging device of claim 21, wherein the object to be charged is photoconductive, and said charge preventive means exposes the approaching region.

23. A charging device for charging a movable object to be charged, comprising:

a charging member which contacts with the object to be charged, and possesses a region approaching to and a region departing from the charging member, a charge preventive means for preventing a charging of the object at the approaching region, and a power source for applying a voltage to the charging member, wherein when a space frequency of a profile of a surface of the charging member is analyzed, a sum of power spectrum ΣPSi in a higher frequency (f: space frequency) than a predetermined frequency value is smaller than a predetermined sum of power spectrum value.

24. A charging device of claim 23, wherein the object to be charged is photoconductive, and said charge preventive means exposes the approaching region.

25. A charging device of claim 20, wherein the object to be charged is photoconductive, and the charge preventive means exposes the approaching region.

* * * * *

UNITED STATES PATENT AND TRADE MARK OFFICE

CERTIFICATE OF CORRECTION

PATENT NO. : 5,548,380
DATED : August 20, 1996
INVENTOR(S) : Naka et al.

It is certified that error appears in the above-identified patent and that said Letters Patent is hereby corrected as shown below:

Column 18, line 55, "deparing" should be --departing--.

Column 18, line 63, "perdetermined" should be --predetermined--.

Signed and Sealed this

Eleventh Day of February, 1997

*Attest:*

*Attesting Officer*

BRUCE LEHMAN

*Commissioner of Patents and Trademarks*